US009364834B2

(12) United States Patent
Wollenhaupt et al.

(10) Patent No.: US 9,364,834 B2
(45) Date of Patent: Jun. 14, 2016

(54) ROLLER PRESS

(71) Applicant: Maschinenfabrik Koeppern Gmbh & Co. KG, Hattingen (DE)

(72) Inventors: Gereon Wollenhaupt, Witten (DE); Eggert Deweldige, Velbert Langenberg (DE)

(73) Assignee: MASCHINENFABRIK KOEPPERN GMBH & CO. KG, Hattingen (DE)

( * ) Notice: Subject to any disclaimer, the term of this patent is extended or adjusted under 35 U.S.C. 154(b) by 0 days.

(21) Appl. No.: 14/434,502

(22) PCT Filed: Oct. 22, 2013

(86) PCT No.: PCT/EP2013/072008
§ 371 (c)(1),
(2) Date: Apr. 10, 2015

(87) PCT Pub. No.: WO2014/090464
PCT Pub. Date: Jun. 19, 2014

(65) Prior Publication Data

US 2015/0283550 A1 Oct. 8, 2015

(30) Foreign Application Priority Data

Nov. 12, 2012 (DE) ..... 10 2012 112 102

(51) Int. Cl.

| | |
|---|---|
| ***B02C 4/02*** | (2006.01) |
| ***B02C 4/28*** | (2006.01) |
| ***B30B 3/04*** | (2006.01) |
| ***B30B 15/04*** | (2006.01) |

(52) U.S. Cl.
CPC ... *B02C 4/02* (2013.01); *B02C 4/28* (2013.01); *B30B 3/04* (2013.01); *B30B 15/04* (2013.01)

(58) Field of Classification Search
CPC ..... B30B 3/04; B30B 15/04; B02C 4/02; B02C 4/28
See application file for complete search history.

(56) References Cited

U.S. PATENT DOCUMENTS

| | | | | |
|---|---|---|---|---|
| 3,899,965 | A | 8/1975 | Koch | |
| 4,395,944 | A * | 8/1983 | Siepermann | B30B 3/04 100/168 |
| 7,451,945 | B2 | 11/2008 | Wollenhaupt | |
| 7,841,552 | B2 | 11/2010 | Frangenberg | |
| 8,297,183 | B2 | 10/2012 | Hoerster | |
| 8,795,563 | B2 | 8/2014 | Splinter | |

* cited by examiner

*Primary Examiner* — James Mackey
(74) *Attorney, Agent, or Firm* — Andrew Wilford

(57) ABSTRACT

The invention relates to a roller press for crushing, compacting and/or briquetting material, comprising a press frame (1) and comprising two pressing rollers (2, 3) rotatably mounted in the press frame, wherein the press frame (1) receiving the pressing forces has a frame upper part (6) and a frame lower part (7) and also head pieces (13, 14) connecting the frame upper part and the frame lower part. This roller press is characterized in that the frame upper part (6) and the frame lower part (7) are connected to one another by way of at least one movable intermediate support (15), which is arranged between the head pieces (13, 14), supports the frame upper part (6) with respect to the frame lower part (7) when the press frame is open and can be transferred from an operating position into a roller removal position, and vice versa.

11 Claims, 8 Drawing Sheets

ROLLER PRESS

CROSS REFERENCE TO RELATED APPLICATIONS

This application is the US-national stage of PCT application PCT/EP2013/072008 filed 22 Oct. 2012 and claiming the priority of German patent application 102012112102.8 itself filed 11 Dec. 2012.

FIELD OF THE INVENTION

The invention relates to a roller press for crushing, compacting and/or briquetting (granular) material, with a press frame and two press rolls rotatable in the press frame, the press frame subjected to the pressing forces being formed by an upper part and a lower part as well as end links connecting the upper and lower parts, it being possible to open the press frame at one or at both ends, for example by virtue of the fact that the end link(s) is (are) rotatably/pivotably connected at one or both ends to the lower part or the upper part. One or more first end links are provided at one end and one or more second end links are provided at the opposite other end.

The (two) press rolls of such a roller press are subject to wear and must therefore be regularly maintained and replaced. To that end, it can be necessary to remove one or both press rolls from the press frame. To do this, the press frame can be opened on at least one side, for example by folding down the end link(s). In order to increase the uptime of a roller press and, consequently, to shorten interruptions for maintenance, the removal of a roller should as quick as possible. Roller presses with "folding frames" have therefore been known for some time.

For instance, DE 23 05 626 [U.S. Pat. No. 3,899,965] describes a roller press of the type described above in which at least one end link or a head bridge is connected to the press frame so as to be rotatable or pivotable, the inner surface of the head bridge acts as a sliding surface and the pivot axis being aligned such that the sliding surface forms an extension of the lower sliding surface of the parallel guide when the head bridge is folded down. In order to replace the roller sets, only the upper attachments of the head bridges have to be detached, the head bridges folded down and any mechanical or hydraulic or pneumatic roller adjustment systems removed, so that the roller sets can easily be pulled forward by factory-installed pullers onto the sliding surfaces of the folded-down head bridges in order to be removed and transported away easily and without difficulties. In order to support the upper part with respect to the lower part during removal of the rolls, common practice is to provide vertical supports between the upper and lower parts. Insofar as they are between the roller axes, such supports do not pose a nuisance if the press frame can be opened on both sides, so the two rolls can be removed from the press frame on different ends (see also WO 2005/070549 [U.S. Pat. No. 7,451,945]).

Alternatively, it has been proposed in the relation to the installation or removal of the rolls that at least one end link be removed from a use position while the upper beam of the upper part is continuously supported, the removable end link being outwardly displaceable transversely to the upper beam of the upper part (cf. WO 2009/007197 [U.S. Pat. No. 8,297,183]). In this embodiment, the upper part is supported with the aid of the end links themselves mounted at the end that are not folded away downward but pushed to the side so that they can also fulfill their support function when the frame is in the "opened."

WO 2007/033800 [U.S. Pat. No. 7,841,552] describes a roller press with a press frame that is provided with an additional frame portal that supports the upper part when the press is in the opened state. The portal spans across the press frame in the area of an end of the frame to be opened, the portal being dimensioned such that the press rolls can be passed through with corresponding mounts. The same applies to the system known from DE 10 2007 059 072 [U.S. Pat. No. 8,795,563].

Finally, another alternative embodiment is known in practice in which the end links can be pivoted outward about vertically running axes, so that they can be folded out in the manner of a "gate," as it were, while also supporting the upper part when the upper part is in the pivoted-out position.

OBJECT OF THE INVENTION

It is the object of the invention to provide a roller press and a press frame for such a roller press that enables the quick removal and installation of both press rolls with a simple and stable construction, preferably toward one end of the machine.

SUMMARY OF THE INVENTION

To achieve this object, in a generic roller press of the type described above, the invention teaches that the upper part and lower part are interconnected via at least one moveable intermediate support arranged between the first and second end links that supports the upper part with respect to the lower part when the press frame is open and can be moved between a use position and a roll-removal position. Preferably, this movable intermediate support is centered between the roller axes. The moveable intermediate support according to the invention can be provided on only one side of the frame or, alternatively, on both sides, and several movable intermediate supports can also be employed.

The invention proceeds from the insight that it is expedient to provide, in addition to the end links on both sides, at least one intermediate support that holds up the upper part when the press frame is opened. Separate holding means, such as crane systems or the like, can therefore be omitted. However, the intermediate support according to the invention is now moveable, that is, it can be moved between a use position and a roll-removal position. In this way, the movable intermediate support can be pivoted on the press frame about a vertical pivot axis, for example, or, alternatively, be arranged on the press frame so as to also be displaceable parallel to the roller axes. In any case, the possibility exists of moving the moveable intermediate support in the event of the removal or installation of a roller, so that the respective roll to be replaced can readily be moved on the inside past the intermediate support. It is thus possible to replace both rolls via one and the same head end of the frame, because even if an intermediate support is in the frame, for example between the rolls, then in order to replace the rear roller when seen from the opened frame end it can be moved into the removal position such that this rear roller can readily be moved past the intermediate support. According to the invention, trouble-free support of the pressing upper part is thus achieved while still enabling both press rolls to be removed and installed again from the press frame via a front end. The mobile design of the intermediate support also has the advantage that the intermediate support assumes a different position when in the use position than in the roll-removal position. In the use position, a solid and stable connection of the upper part and lower part is achieved that is located near the roll ends. Moreover, in the use position, a collision of the intermediate support with the essential components of the system, for example transmission and/or drive of the rolls, is avoided. On the other hand, in the roll-removal position the axle pin or shaft journal does not collide with the intermediate support when the transmission/drive is removed during disassembly. This can be achieved, for example, by arranging the intermediate support on the press frame so as to be rotatable about a vertical axis. For this purpose, the intermediate support itself can be C-shaped or have a C-shaped pivot bracket that is pivotably attached to the press frame or to two mounting pieces. Such a C-shaped design of the intermediate support or of the pivot bracket makes it possible for the vertical arm of the C-shaped bracket to be arranged near the roller in the use position and at a maximum spacing from the roller in the mounting position, thus enabling trouble-free removal and installation of the rolls. However, the invention also includes alternative embodiments in which the movable intermediate support does not pivot but is pushed outward in order to create the appropriate clearance.

It is possible in principle to provide a movable intermediate support only on one side between the end links, for example between the roller axes. Alternatively, however, it also lies within the scope of the invention to provide a respective movable intermediate support on both sides of the press frame, so that each of the intermediate supports can then be moved into a roll-removal position on both sides of the press frame. In practice, however, a provision is frequently made that the rolls each have a short and a long axle pin, the long axle pin or shaft journal being used for the connection of the roller drive. In such a case, it can be sufficient if only one movable intermediate support is on the drive side. On the opposite non-drive side, an additional rigid intermediate support can then optionally be provided. As a result, the upper part is also reliably supported. However, the space requirement in the case of removal is less and the rigid support is more cost-effective. Due to the asymmetrical design of the press rolls, it is thus possible to do without a movable intermediate piece on both sides.

Optionally, it lies within the scope of the invention to provide other supports in addition (or as an alternative) to the movable intermediate support(s) and the rigid intermediate support(s) that may optionally be provided, namely additional supports that are not between the roller axes but—when seen from the front frame end—behind or in front of the respective roller axis and consequently between the roller axis and the nearest end link. Stability can be further improved through such additional supports. They are preferably only in the area of the pressing side via which a replacement of the roller is not planned. After all, if both rolls are replaced via a front end of the press, one or more additional supports can be provided in the area of the opposing end between the roller axis and the end link there past which no roller needs to be moved. Optionally, however, it also lies within the scope of the invention to also design these additional supports as movable additional supports, so that the press frame is then characterized by maximum flexibility with simultaneously high stability.

The invention is first characterized by the separation of the frame parts into those that primarily receive the pressing force and those that keep the construction stable in the opened state. The pressing force is withstood by the press frame that is composed of an upper part, lower part and the end links or supports at both ends. On the other hand, the additional intermediate supports and the optional additional supports are not intended to withstand pressing forces and are consequently not designed for tensile loads; rather, they act as braces, particularly when the press frame is opened at one or both ends for roller replacement. Such support components bearing lower loads can have smaller dimensions and be fitted into tighter structural spaces than the parts of the frame receiving the pressing force. Another advantage is that the parts of the frame receiving the pressing force can assume other functions, for example as frame extensions in the folded-open state for removal of rolls.

The supports increase the stability, not only when the frame is opened but also when closed. The overall stability is thus increased, particularly also when the upper part has to carry other components. The support, for example movable support, can perform other, secondary functions; for example, it can carry other devices such as lateral roller gap sealing plates, for example, and parts of the roller fittings as well as spacer bolts, reverse-pressure cylinders or the like. The same applies to heavy superstructure parts, such as material feeders, etc. In such a case, in which the movable support carries such components, the possibility of pivoting out has the additional advantage that parts that would otherwise get in the way during removal of the roller, particularly the floating roller, can also be pivoted out with the support.

Even though the movable support according to the invention particularly makes it possible to replace both rolls via one end, it lies within the scope of the invention for both ends of the press to be openable. This can be advantageous, for example, if the pressing hydraulics of the movable roller is to be serviced or replaced without removing the rolls.

The moving of the movable intermediate support between the use position into the removal position can be done manually or, also preferably, by suitable drives, such as hydraulic drives, mechanical drives or the like.

Moreover, it can be advantageous to lock the intermediate pieces in the use position and/or the removal position.

Overall, the press frame according to the invention is characterized by a high level of stability while having great flexibility. The system can be constructed in modular fashion, so that both a conventional press frame without a movable intermediate piece and a press frame according to the invention with movable intermediate piece can be put together using the same components.

The invention also relates to a press frame for a roller press of the described type. The press frame itself consequently has special significance, for which reason protection is also sought independently for the press frame.

BRIEF DESCRIPTION OF THE DRAWING

The invention is explained in further detail below with reference to a drawing showing a single embodiment.

SPECIFIC DESCRIPTION OF THE INVENTION

Figure 1A:
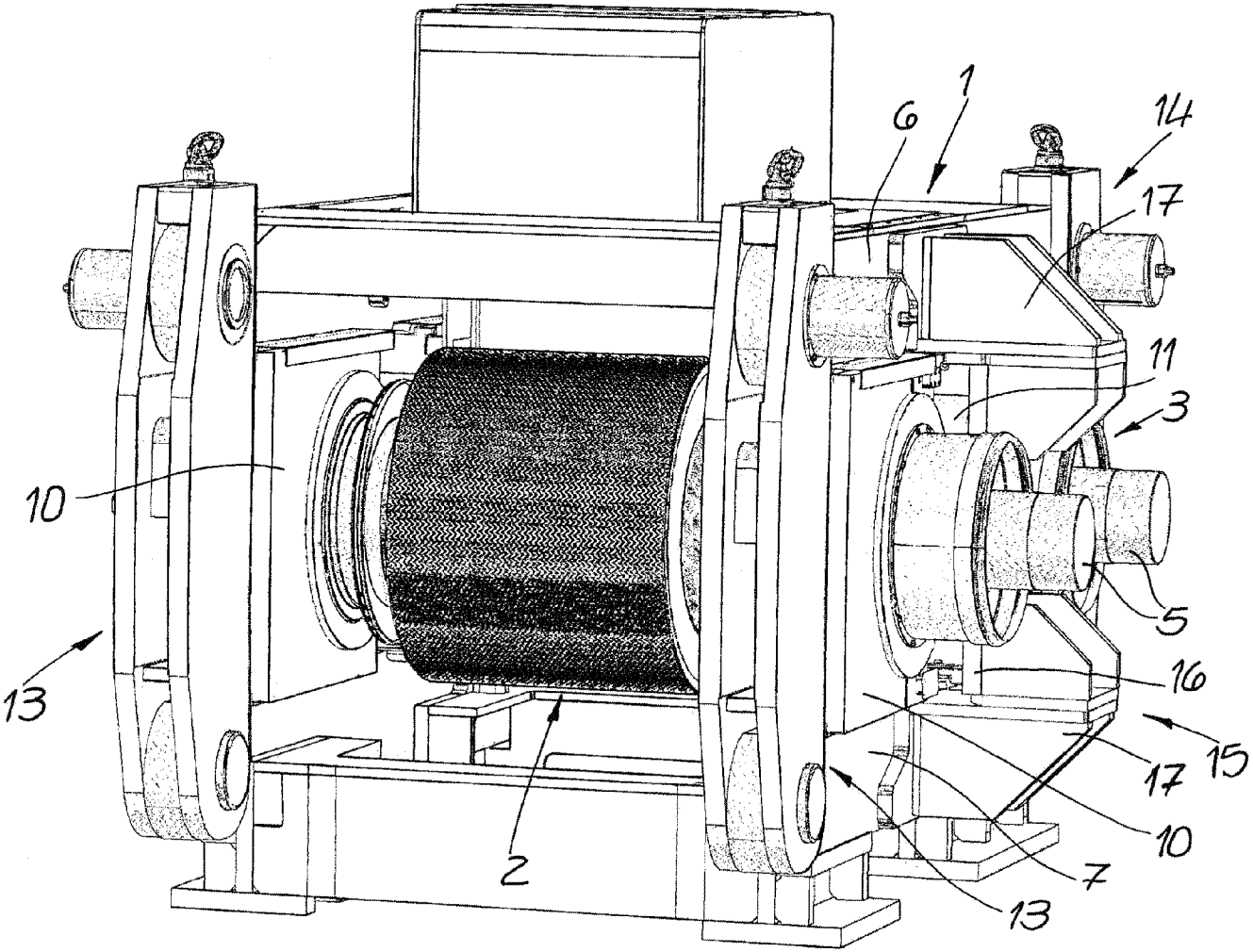
FIGS. 1*a* to 1*e* are perspective views of a roller press according to the invention in different functional positions.

The figures show a roller press designed for crushing, compacting or briquetting (granular) material. Such a roller press has a press frame 1 and two press rolls 2 and 3 mounted in the press frame to as to pivot against one another. The two press rolls 2 and 3 are driven. They are each connected via a respective axle pin 5 to a transmission 4 and a drive. Alternatively, one transmission can also drive both rolls (double-shaft drive).

The press rolls 2 and 3 are mounted in the press frame 1. The press frame 1 has an upper part 6 and a lower part 7 as well as end links 13 and 14. The press frame 1 formed from the upper part 6, lower part 7 and end links 13 and 14 withstands the pressing forces during operation. Two end links 13 and 14 are respectively provided on each frame end. As a result, the press frame 1 has the two first end links 13 at one end and the two second end links 14 at the opposite end. The press rolls 2 and 3 are each pivotably mounted in chocks 10 and 11. The press roll 2 is fixed, whereas the press roll 3 floats and thus is movable. As a result, the floating roller 3 is displaceable with its chocks 11 in the press frame 1, particularly in a horizontal direction R perpendicular to the roller axes A. The floating roller 3 is acted on by an actuator (not shown), such as pressing cylinders so that the pressing gap and the pressing force can be adjusted by the floating roller. Such construction and functionality are known in principle in roller presses.

Figure 1B:
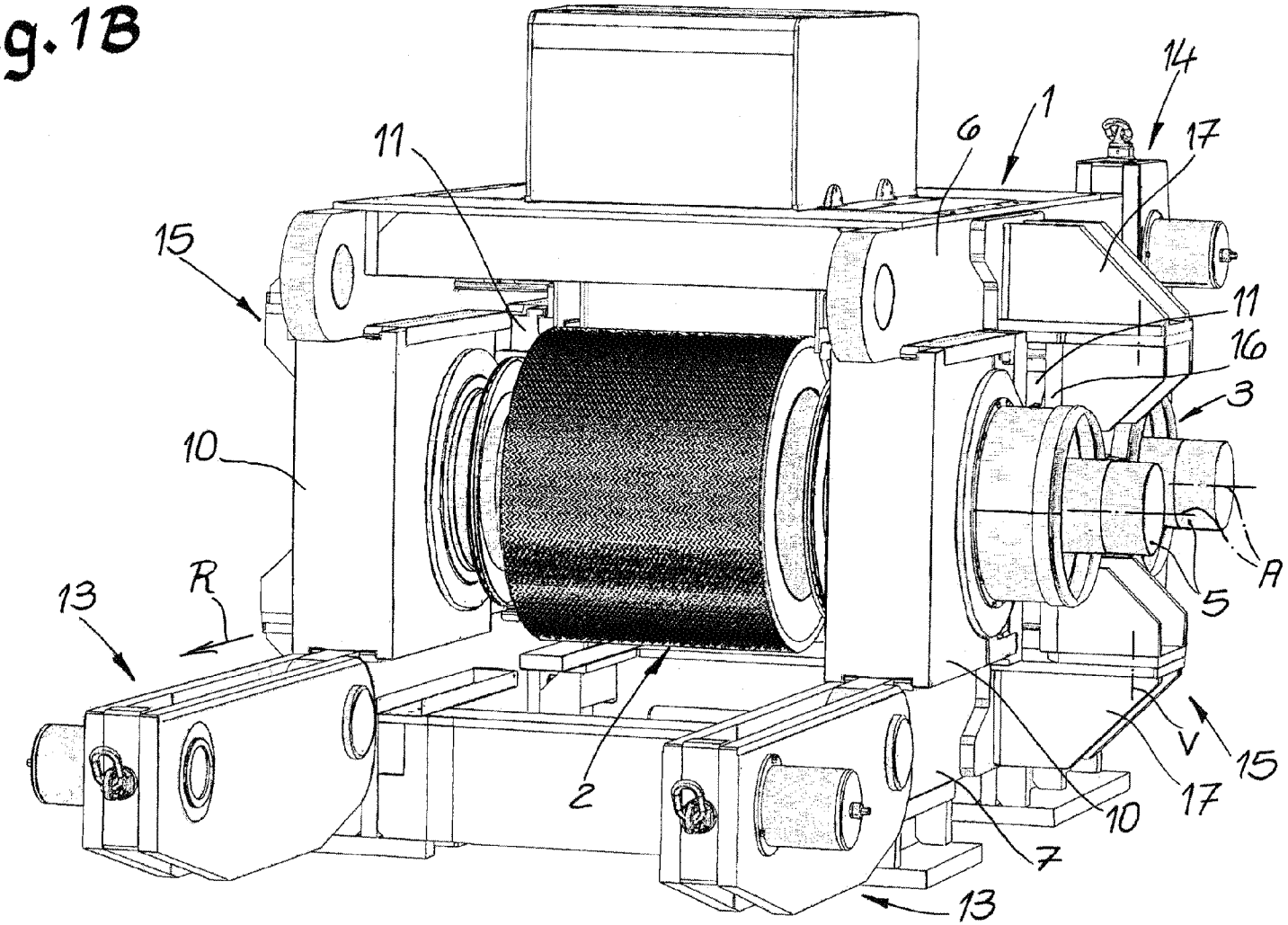
Figure 1C:
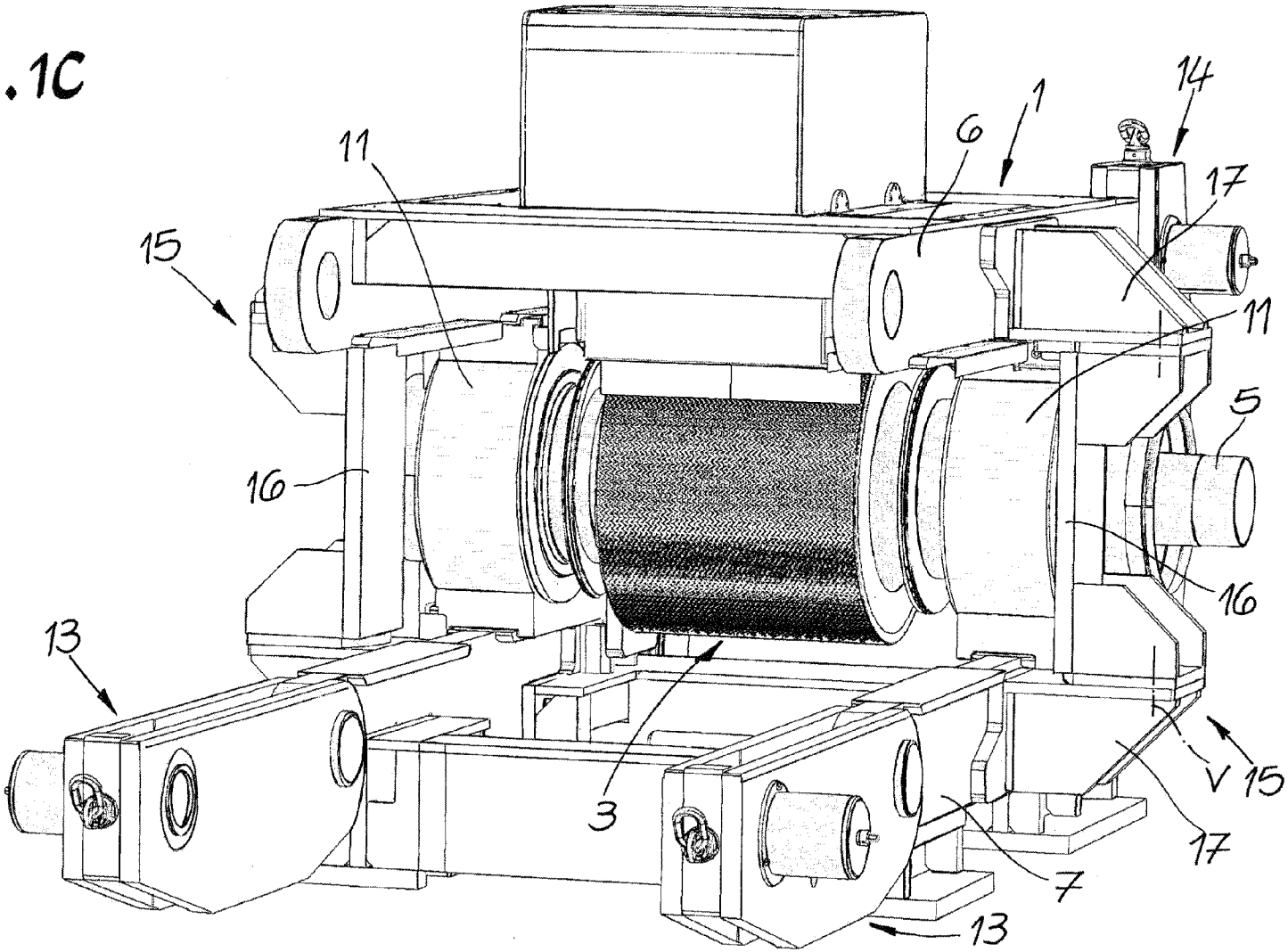
Figure 1D:
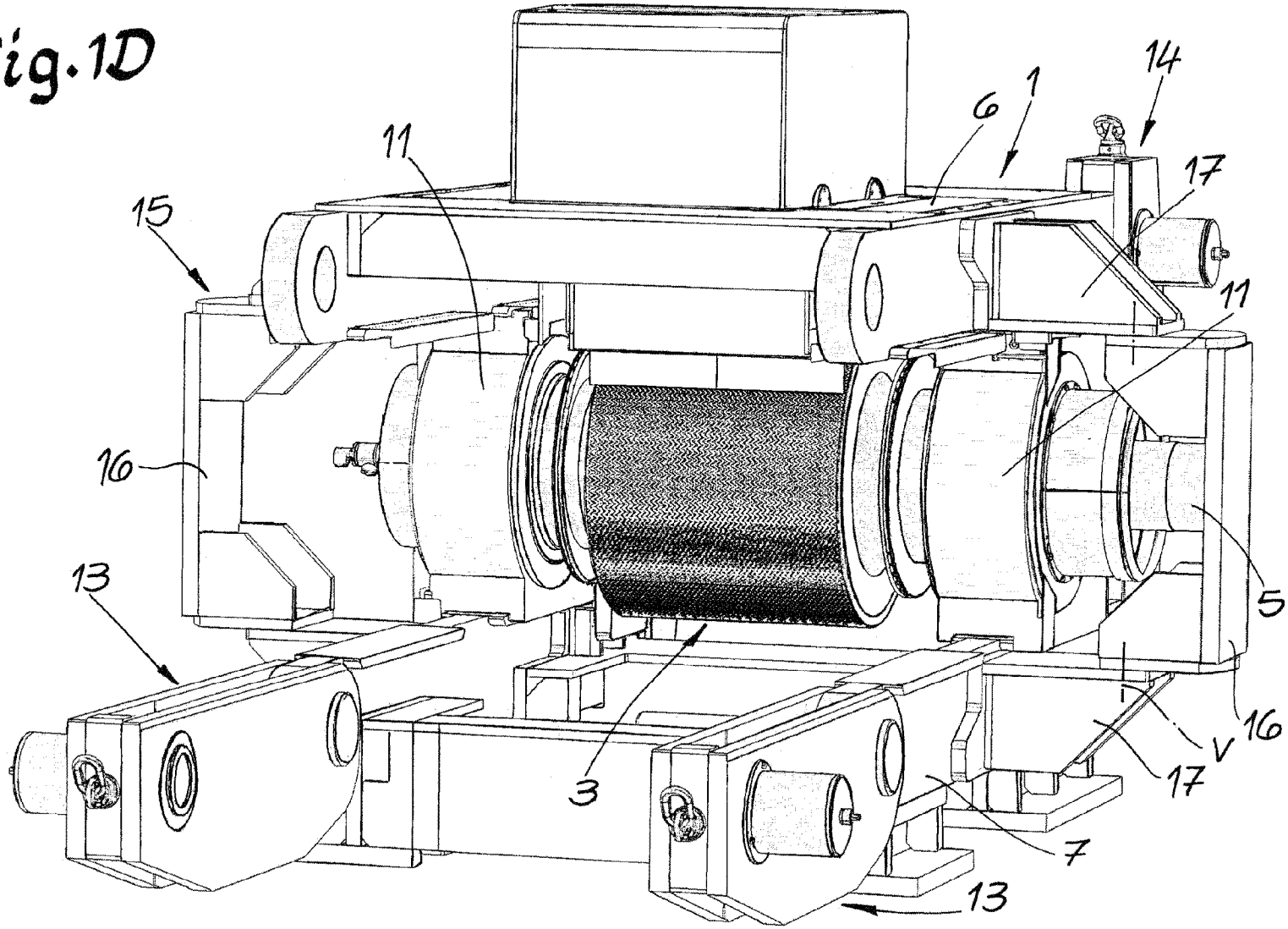
Figure 1E:
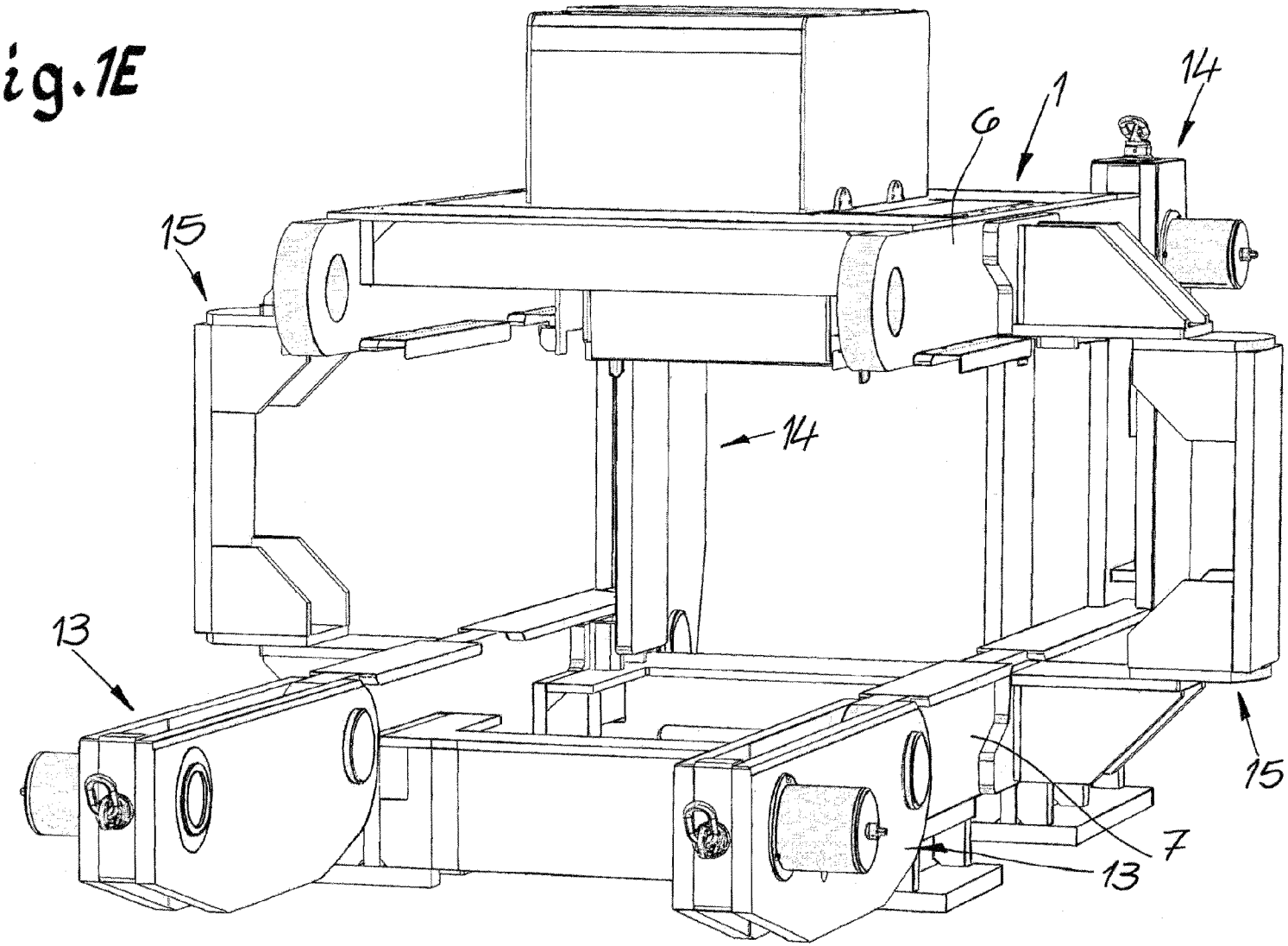

To enable the removal and installation of one or both press rolls 2 and 3, provision is made in a basically known manner that the press frame 1 can be opened at one or both ends. For this purpose, in the illustrated embodiment, both the first end links 13 and the second end links 14 are pivotably connected to the lower part 7. This can be seen from a comparison of FIGS. 1*a* and 1*b*. The end links 13 according to FIG. 1*a* are clearly shown as being in a vertical use position. For the purpose of roller replacement, the first end links 13 are folded open out of the position according to FIG. 1*a* into a horizontal position according to FIG. 1*b*. In the illustrated embodiment these are the end links 13 associated with the fixed roller 2. According to the invention, however, it is possible to replace not only the fixed roller 2 via the opened end but also the floating roller 3. This can be seen in comparing FIGS. 1*a* to 1*e*. Separate supports for the upper part 6 can be omitted.

This is because, according to the invention, the upper part 6 and the lower part 7 are connected to one another via intermediate supports 15, and the upper part is held reliably even when the first and/or second end links 13 and 14 are folded open.

The intermediate supports 15 between the upper part 6 and lower part 7 support the upper part 6 particularly when the press frame is open with respect to the lower part 7. In the illustrated embodiment according to FIGS. 1*a* to 1*e*, both intermediate supports 15 are movable. A comparison of FIGS. 1*a* to 1*e* shows that these movable intermediate supports 15 can move from a use position (FIGS. 1*a* to 1*c*) to a roll-removal position (FIGS. 1*d* and 1*e*) and vice versa. The movable intermediate support 15 is centered between the two roller axes A in the illustrated embodiment. The movable intermediate support 15 can be rotated about a vertical axis of rotation V. For this purpose, the movable intermediate support 15 has a pivotal C-shaped pivotal bracket 16 that is pivotably carried on mounts 17 that are fixed to the upper frame part 6 and to the lower frame part 7.

While both intermediate supports are embodied as movable intermediate supports in the embodiment according to FIGS. 1*a* to 1*e*, FIGS. 2*a* and 2*b* show a slightly modified variant with only one movable intermediate support 15. This will be addressed in further detail below. However, the construction and functionality of the movable intermediate supports are identical in both illustrated embodiments.

Figure 2A:
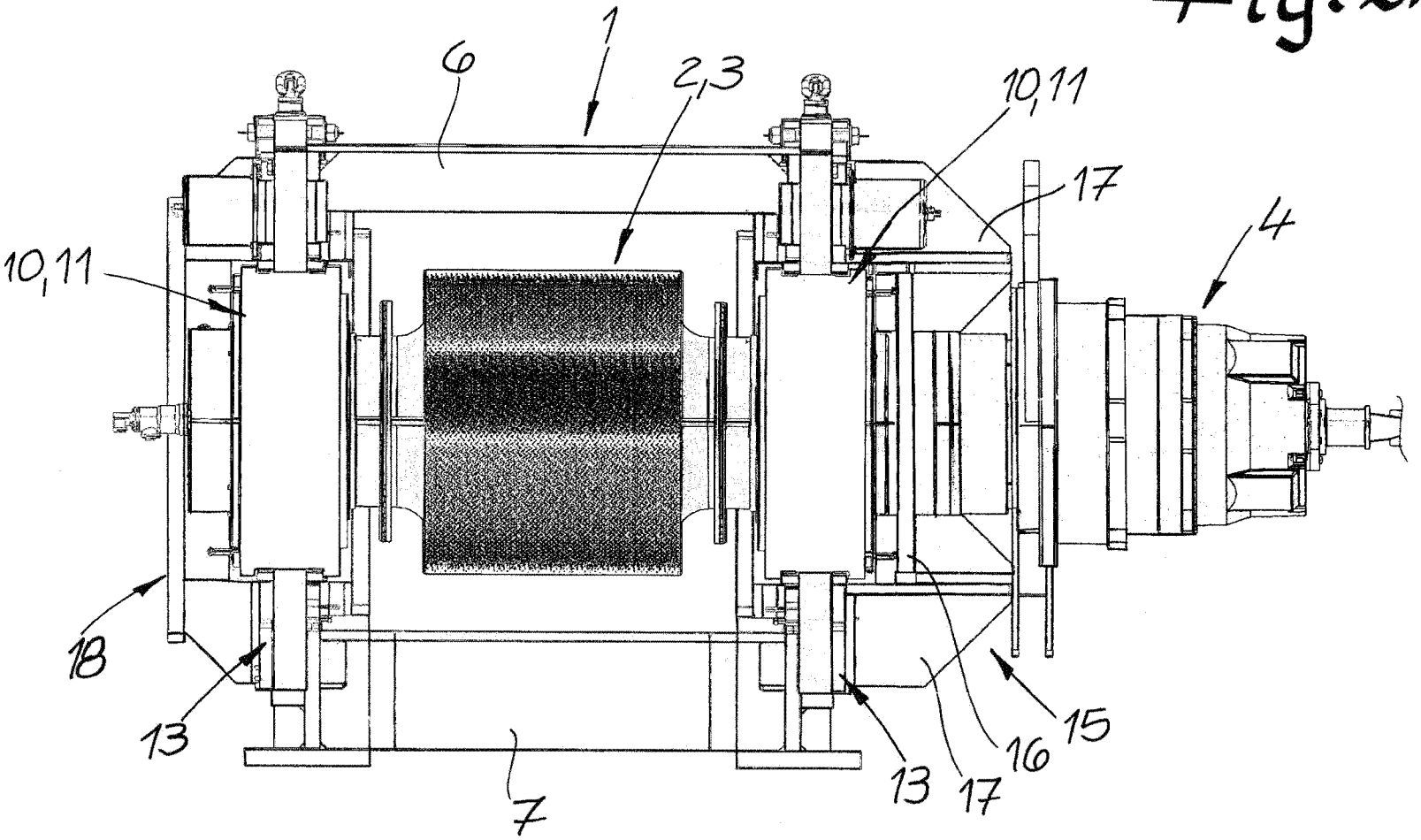
FIG. 2*a* is a front view of a modified variant of the press of to FIG. 1*a* in the use position.
Figure 2B:
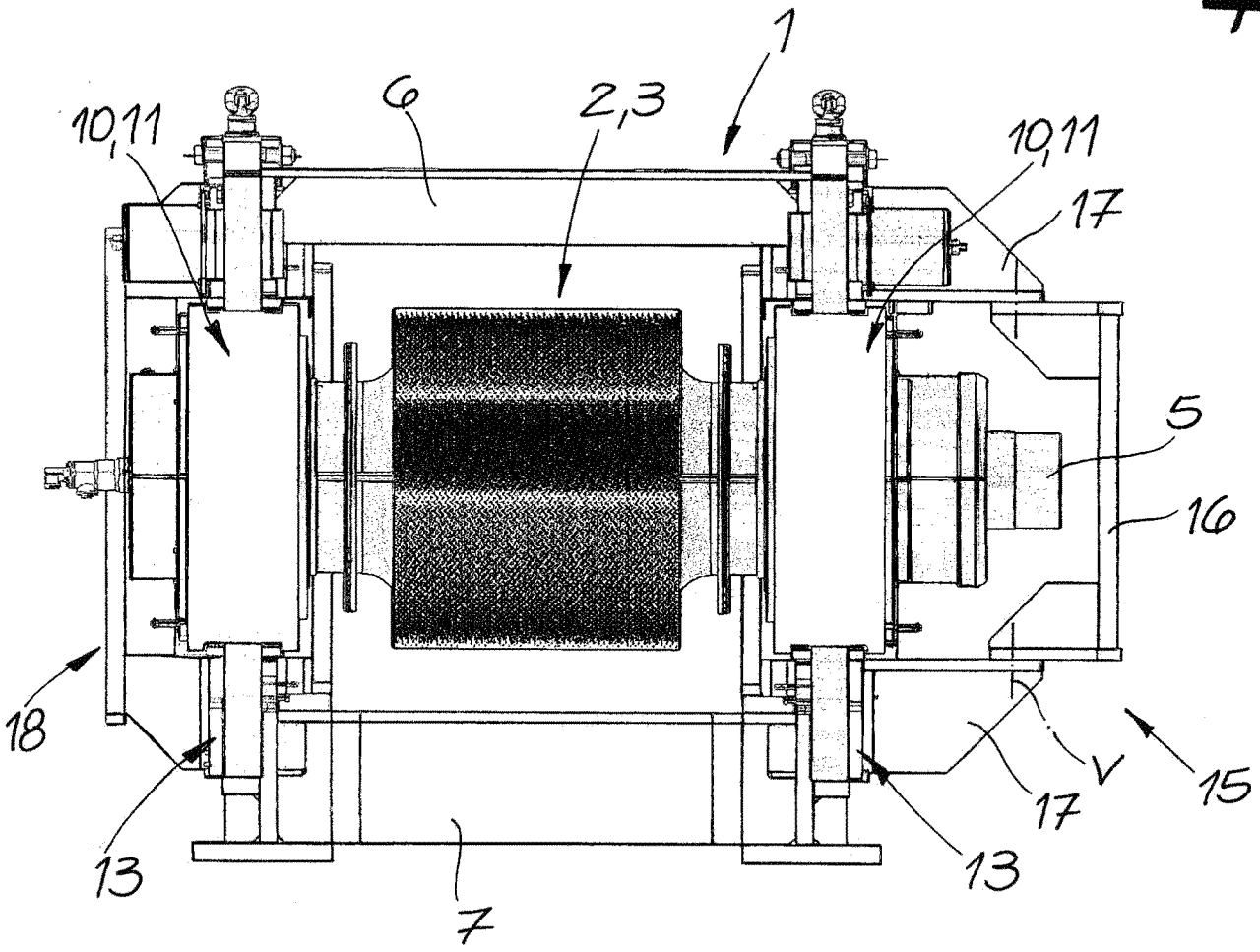
FIG. 2*b* shows the press of to FIG. 2*a* in the removal position.

FIG. 2*a* shows the use position with the pivot bracket 16 pivoted in, whereas FIG. 2*b* shows the removal position with the pivot bracket 16 pivoted out. It becomes clear that the geometry is selected such that the pivot bracket 16 does not get in the way of the roller and particularly the transmission 4 thereof in the installed state in its use position. In the roll-removal position according to FIG. 2*b*, however, the roller can be removed in a trouble-free manner after disconnection of the transmission 4 despite the longer axle pin 5. It can be seen clearly from FIG. 2*a* that the area of the greatest diameter of the planetary transmission lies in the area in which unobstructed movement of the axle pin 5 is required.

Removal of the rolls follows in steps shown in FIGS. 1*a* to 1*e*.

FIG. 1*a* shows the roller press in the use position. Both press rolls 2 and 3 are installed and the movable intermediate supports 15 are in the use position. The same applies to the end links 13 and 14. In order to enable removal of the two press rolls 2 and 3, the first end links 13 on the end of the fixed roller 2 are folded down. Now the fixed roller 2 can be removed. This can be seen from a comparison of FIGS. 1*b* and 1*c*. Before the rear roller and, consequently, the floating roller 3 can be removed via the same opening, at least one of the movable intermediate supports 15 must be rotated. For this purpose, the pivot bracket 16 is rotated about a vertical axis until it assumes the roll-removal position shown in FIG. 1*d*. The necessary clearance for the axle pin 5 is thereby made available, so that the second roller 3 can now be removed from the press frame 1 through the same opening (cf. FIG. 1*e*).

Figure 3:
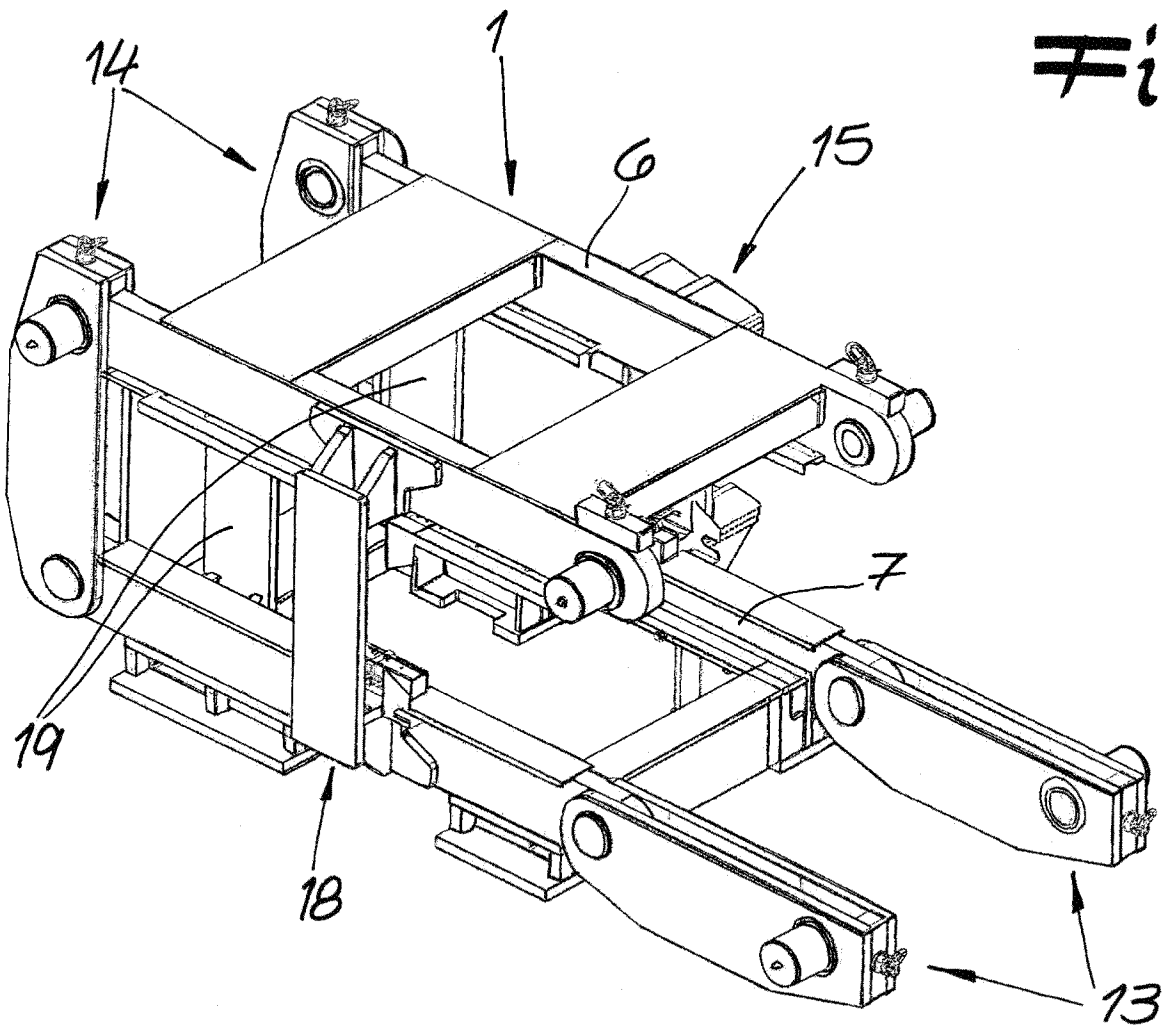
FIG. 3 is a perspective view of a press frame of the press according to FIG. 2*a*.

As already explained, according to the invention, at least one movable intermediate support 15 is provided between the upper part 6 and the lower part 7, particularly at least on the frame side on which the longer axle pin 5 is. FIGS. 2*a*, 2*b* and 3 show an embodiment in which only one such movable intermediate support 15 is provided. In addition to the movable intermediate support 15, a fixed intermediate support 18 is mounted between the upper part 6 and the lower part 7 on the opposite frame side. Since it is on a side opposite the longer axle pin, it need not be movable. This rigid intermediate support 18 can be seen especially well in FIG. 3 that only shows the press frame 1 without the rolls and in an end view opposite that of FIGS. 1*a* to 1*e*.

The embodiment according to FIGS. 1*a* to 1*e* differs from the embodiment according to FIGS. 2*a*, 2*b* and 3 merely in that no additional rigid intermediate support 18 is provided, two movable intermediate supports 15 being provided instead. This results in especially flexible use of the press frame. Even if a movable intermediate support were not necessary on one frame side due to the shorter axle pin, such an embodiment with two movable intermediate supports has the advantage that other machine components can be pivoted out of the area between the rolls with this (second) movable intermediate support that would otherwise be in the way during removal of the roller, particularly of the floating roller. As a result, it is possible to attach other machine parts to a movable intermediate support 15 that are then pivoted out along with the intermediate support 15. Details are not shown in the figures.

Finally, the figures show that, in addition to the movable intermediate supports 15 and, optionally, the rigid intermediate supports 18, other supports, namely additional supports 19, can be provided. In the illustrated embodiments, unlike the intermediate supports 15 and 18, these are not between the roller axes A, but between a roller axis A and the nearest end links. In the illustrated embodiments, these additional supports 19 are between the roller axis of the floating roller 3 and the respective end links, namely the second end links 14. Since the two rolls 2 and 3 are removed from the same side, these additional supports 19 do not get in the way. They are therefore rigid supports 19 in the illustrated embodiment and consequently not movable.

The invention claimed is:

1. A roller press for crushing, compacting and/or briquetting granular material, the press comprising:

a press frame;

two press rolls rotatable about respective roll axes in the press frame, the press frame subjected to the pressing forces having at least one upper part, at least one lower part, at least one first end link, and a second end link that together with the first link connects the upper part and lower part; and at least one movable intermediate support interconnecting the upper part and lower part, arranged between the first and second end link, supporting the upper part when the press frame is open with respect to the lower part, and movable between a use position and a roll-removal position.

2. The roller press as defined in claim 1, wherein the movable intermediate support is between the roll axes.

3. The roller press as defined in claim 1, wherein the movable intermediate support is pivotal on the press frame about a vertical axis of rotation.

4. The roller press as defined in claim 1, wherein the movable intermediate support is displaceable on the press frame parallel to the roll axes.

5. The roller press as defined in claim 3, wherein the movable intermediate support is C-shaped or has a pivotal C-shaped bracket.

6. The roller press as defined in claim 1, wherein two of the movable intermediate supports flank the frame or the rolls.

7. The roller press as defined in claim 1, wherein at least one such movable intermediate support is provided between the first and second end link only on one side, and that the upper part and lower part are further supported between the first and second end link between the roll axes by at least one rigid intermediate support on the frame opposite the movable intermediate support.

8. The roller press as defined in claim 1, further comprising:

one or more additional supports attached between a roll axis and the respective end link.

9. The roller press as defined in claim 1, further comprising:

at least one drive for moving the movable intermediate support between the use position and the roll-removal position.

10. The roller press as defined in claim 1, further comprising:

a latch for locking the movable intermediate support in the use position or in the roll-removal position.

11. The roller press as defined in claim 1, further comprising:

machine components attached to the movable intermediate support near or between the rolls in the use position and pivotal out with the intermediate support into the roll-removal position.

* * * * *